US005439219A

United States Patent [19]

Vincent

[11] Patent Number: 5,439,219

[45] Date of Patent: Aug. 8, 1995

[54] GOLF CLUB SHAFT WITH OPTIMIZED DISTRIBUTION OF FLEXIBILITY

[75] Inventor: Benoît Vincent, Annecy Le Vieux, France

[73] Assignee: Taylor Made Golf Company, Inc., Carlsbad, Calif.

[21] Appl. No.: 255,733

[22] Filed: Jun. 7, 1994

[30] Foreign Application Priority Data

Jun. 21, 1993 [FR] France ..... 93 07714

[51] Int. Cl.[6] ..... A63B 53/10

[52] U.S. Cl. ..... 273/80 B; 273/DIG. 23

[58] Field of Search ..... 273/77 R, 77 A, 80 R, 273/80 B, DIG. 23, DIG. 7, 73 F, 193 R, 186.2, 80.9, DIG. 3

[56] References Cited

U.S. PATENT DOCUMENTS

| | | | |
|---|---|---|---|
| 2,250,429 | 7/1941 | Vickery | 273/80 |
| 4,000,896 | 1/1977 | Lauraitis | 273/80 R |
| 4,319,750 | 3/1982 | Roy | 273/80 B |
| 4,555,112 | 11/1985 | Masghati | 273/77 A |
| 4,563,007 | 1/1986 | Bayliss | 273/80 B |
| 4,725,060 | 2/1988 | Iwanaga | 273/77 A |
| 4,900,025 | 2/1990 | Suganuma | 273/77 A |
| 5,088,735 | 2/1992 | Shigetoh | 273/80 B |
| 5,143,374 | 9/1992 | Shibasaki | 273/80 B |

FOREIGN PATENT DOCUMENTS

| | | | |
|---|---|---|---|
| 1451713 | 10/1976 | United Kingdom . | |
| 2053698 | 2/1981 | United Kingdom | 273/80 B |
| 8100521 | 3/1981 | WIPO | 273/80 B |

*Primary Examiner*—Sebastiano Passaniti
*Attorney, Agent, or Firm*—Sandler, Greenblum & Bernstein

[57] ABSTRACT

The invention is related to a golf club shaft with improved distribution of flexibility. It includes a tubular section whose flexional rigidity evolves according to the length and has several portions, including a rigid upper portion extending from the upper end of the shaft having the largest diameter, having a length (L1) at least equal to 200 mm and whose flexional rigidity is at least equal to 50 N·m$^2$; a central portion joined to the other end of upper portion having a length (L2); a lower portion joined to central portion, having a length (L3) and extending to the lower end adapted to receive the club head; the central portion being constituted of a flexible zone of a length between 100 and 300 mm of a remaining zone having a flexional rigidity greater or equal to 50 N·m$^2$.

10 Claims, 4 Drawing Sheets

EI
(N.m²)
90
80
70
60
50
40
30
20
10
C2
C1
200 300 400 500 600 700 800 900 1000 1100
L
(m.m)

(tr/mn)
(m/s)
4500
3500
2500
74
72
70
68
66
T
V
10 30 50 70 90 110
(N m²)

GOLF CLUB SHAFT WITH OPTIMIZED DISTRIBUTION OF FLEXIBILITY

BACKGROUND OF THE INVENTION

1. Field of the Invention

The object of the present invention is an improved golf club shaft and it is related more specifically to a shaft of a composite material whose flexibility distribution has been optimized in order to better the performance of the club. The invention is also related to a golf club equipped with such a shaft.

2. Discussion of Background and Material Information

Prior art club shafts are generally shaped like a truncated tubular section whose biggest diameter is found at the upper end (generally called the "butt"), adapted to receive the grip of the club and the smallest diameter is located at the lower end (called the "tip"), adapted to receive the club head. Flexional rigidity, which is the product of Young's modulus for the material (E) and the inertia of the section (1) decreasing substantially exponentially from the "butt" end towards the "tip" end, whereby $1=\pi\ (D^4-d^4)/64$ (and whereby D=external diameter and d=internal diameter of the shaft) (FIG. 1). The rigidity values (EI) at the "butt" end of the shaft vary depending on the commercial availability of a shaft, from 60 to 100 $N\cdot m^2$ (Newton·meters$^2$), but the rate of the curve remains substantially the same.

For conventional shafts selected from among those whose "butt" portion has low rigidity values, a substantial increase of the head speed is obtained, and consequently, the launching speed of the ball. However, flexibility is distributed along the entire length of the shaft due to conventional shaft design as is shown by the rate of the curve (C2) of FIG. 1. Shaft deformation speed during swing movement (and more specifically during the "release" phase before impact) adds to the drive speed of the shaft generated by the player and produces an increase of the order of 1 to 2 m/s (meters per second).

However, the speed of rotation ("back spin") and the angle at which the ball leaves with such so-called "flexible" shafts are greater than with other shafts. The flight paths of the balls are therefore higher and the ball stops more quickly upon striking the ground; this means that in terms of distance, the results are no greater than those achieved with conventional shafts having standard rigidity (curve C1). Rectification by decreasing the surface angle (called "static" loft) is not enough to adequately modify the values of these two parameters in order to improve club performance.

U.S. Pat. No. 4,319,750 discloses a shaft made of a composite material whose first 250 mm (millimeters) from the "butt" end are rendered more flexible with respect to the remainder of the shaft. This zone of reduced flexional rigidity corresponds to the gripping area of the club. The hands of the player surround or embed the club in this area, thereby resisting deformation in this area. Consequently, a greater flexibility in this area is hardly efficient, and the player is all the more disturbed because he has a tendency to fasten tightly onto the grip of the club in order to resist the deformation thus produced.

SUMMARY OF THE INVENTION

An object of the present invention is to optimize the distribution of the flexional rigidity of the shaft in accordance with its length so as to improve the general performance of the club, without disturbing the player, by displacing the flexibility outside of the hands of the player.

To do this, the shaft as per the invention is constituted of a tubular section having a flexional rigidity that evolves according to the length, comprising several portions:

- a rigid upper portion (at the "butt") extending from the upper end of the shaft with the greatest diameter, having a length (L1) at least equal to 100 mm, preferably 200 mm, and whose flexional rigidity is at least equal to 50 $N\cdot m^2$;
- a central portion joined to the lower end of the upper portion, having a length (L2);
- a lower portion joined to the central portion, having a length (L3) and extending up to the lower end intended to receive the club head;
- wherein the central portion comprises a zone that is joined to the rigid upper portion, having a length (d) comprised between 100 and 300 mm and wherein flexional rigidity is comprised between 20 and 40 $N\cdot m^2$; it being understood that $L1+d \leqq 500$ mm; and,
- a remaining zone joined to the flexible zone, and whose flexional rigidity decreases from a value greater or equal to 50 $N\cdot m^2$ in the vicinity of the flexible zone towards the lower portion to which it is joined.

The flexible zone is located in that portion of the shaft that is most biased during swing movement; in other words, just in front of the area corresponding to the embedding of the club by the hands of the player. The latter is rigid enough not to disturb the player. Beyond this flexible zone, the shaft portion is once again rigid so as to maintain a satisfactory rotational rate of the ball (back spin) and a satisfactory ball launching angle.

According to an advantageous characteristic, the flexional rigidity of the upper portion of the golf club shaft is reduced in a direction from the upper end of the shaft towards the other end that is joined to the central portion.

The inventor has determined that the areas towards the "tip" end of the shaft influence the ball speed and rotation parameters only during time of contact with the ball. This portion, on the contrary, is hardly biased during swing movement, as opposed to the portion in the vicinity of the "butt" end. As such, it is advantageous to retain a minimal rigidity value, either constant or progressively variable towards the "tip" end so as to reduce the rotational speed of the ball.

Thus, according to a first characteristic of the invention, the lower portion whose length (L3) is comprised between 200 and 300 mm has a flexional rigidity greater than or equal to 20 $N\cdot m^2$.

According to a complementary characteristic, the flexional rigidity of the lower portion increases from the end that is joined to the central portion towards the lower end of the shaft.

According to an alternative characteristic, the flexional rigidity of the lower portion is substantially constant along the entire length (L3).

In order to obtain distribution of rigidity as per the invention, and especially, a flexible zone at given values, without having to design a special geometry for the shaft, the thickness of the tubular wall of the shaft comprises a series of fiber-based composite material layers, such fibers being oriented in a direction parallel to the longitudinal axis of the shaft, and fiber based layers that are inclined with respect to the longitudinal axis of the shaft; the fibers that are oriented along a direction parallel to the longitudinal axis being for the most part fibers having a lower elastic modulus, in the flexible zone, than the elastic modulus of similarly oriented fibers outside of the flexible zone.

According to a complementary characteristic of the invention, the fibers oriented in a direction parallel to the longitudinal axis in the flexible zone are, for the most part, made of glass and/or aramide.

According to another characteristic of the invention, the fibers oriented along a direction parallel to the longitudinal axis outside the flexible zone are, for the most part, made of graphite.

According to another complementary characteristic of the invention, the fibers that are inclined with respect to the axis of the shaft are, for the most part, made of graphite.

BRIEF DESCRIPTION OF THE DRAWINGS

Other characteristics and advantages of the invention will become apparent from the following description with respect to the annexed charts and drawings and wherein.

DETAILED DESCRIPTION OF THE PREFERRED EMBODIMENTS

Figure 1:
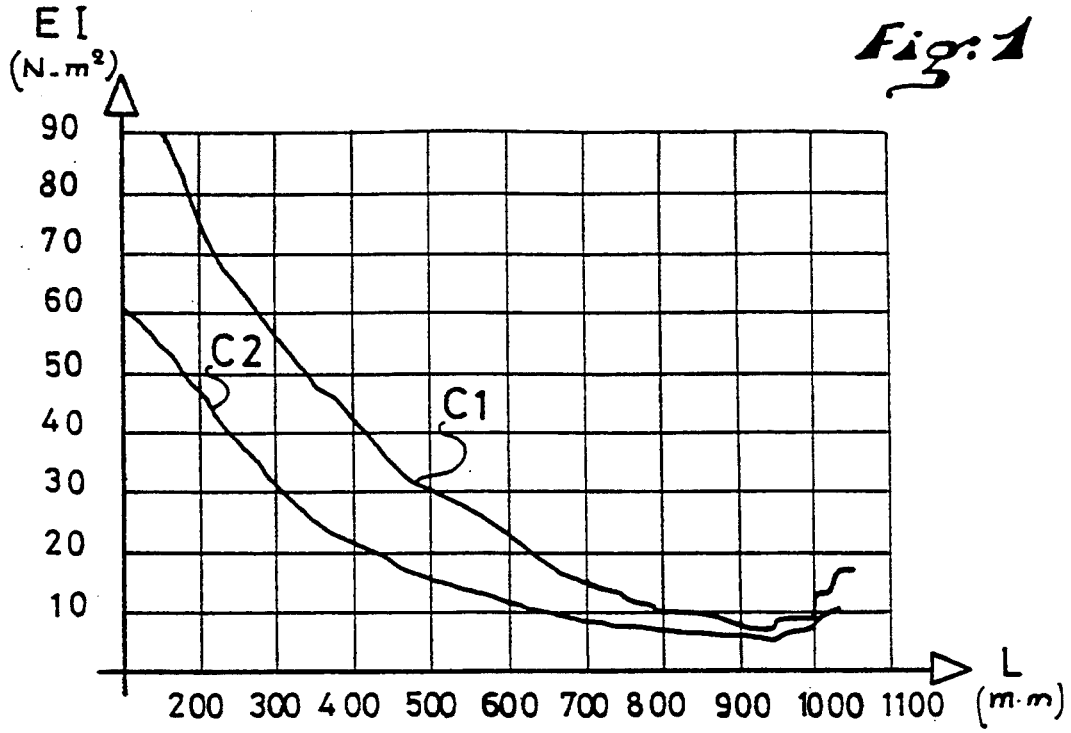
FIG. 1 represents a graph showing the distribution of flexional rigidity (EI), expressed by $N \cdot m^2$ in the Y-axis; according to the length of shaft (L), expressed in millimeters in the X-axis, for a commercially available "rigid" shaft (C1) and a commercially available "flexible" shaft (C2).

As is shown in FIG. 1, the curve rate of the distribution of flexional rigidity (EI) according to length has a shape that decreases substantially exponentially from the upper end of the shaft, called the "butt" end, towards the lower or "tip" end. Curve (C1) illustrates the case of a commercially available "rigid" shaft having a conventional truncated shape whose flexional rigidity at the "butt" end is greater than 90 $N \cdot m^2$. The decrease is due, in a large part, to the decrease in section or diameters in the direction of the "tip" end and whose formula is:

$EI = E \cdot \pi (D^4 - d^4)/64$, whereby D = external diameter of the shaft, d = internal diameter, E = Young's modulus of the material.

Curve (C2) illustrates the case of a commercially available "flexible" shaft whose flexional rigidity at the "butt" is close to 60 $N \cdot m^2$. The rate of the curve is identical to that of (C1).

Figure 2:
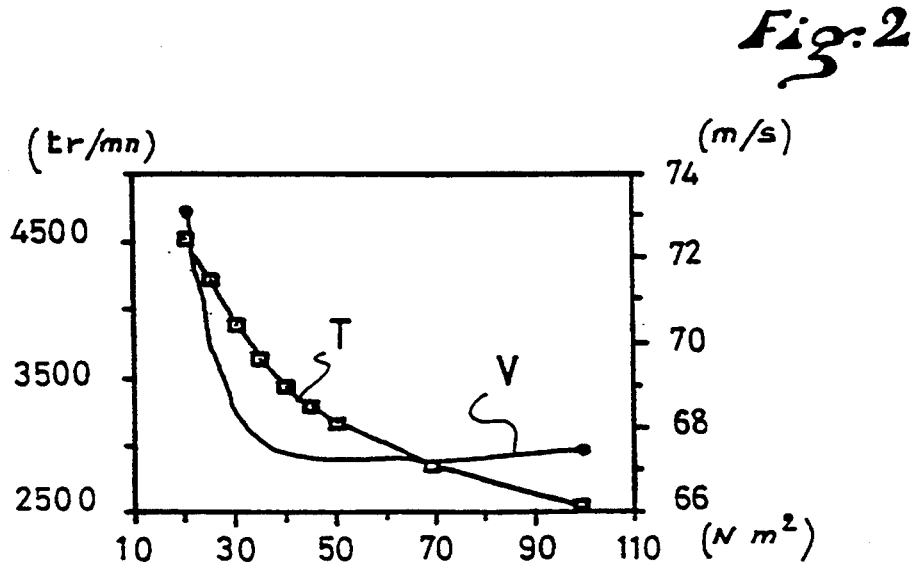
FIG. 2 represents a graph showing the influence exerted by the rigidity of a series of shafts having constant rigidity (in the X-axis) on the evolution of the speed of the ball (in the Y-axis on the right expressed in m/s and curve V) and on the evolution of the rate of rotation (in the Y-axis on the left in revolutions/minute and curve T).

The influence of rigidity on the parameters of speed and rotational rate of the ball is illustrated as an example in FIG. 2. For a shaft having constant rigidity along its entire length (constant diameter and homogeneous material), it is noted that the more flexible the shaft ($EI \leqq 70N.\ m^2$), the higher the values for the speed of the ball (V) and rotational rate (T).

Figure 3:
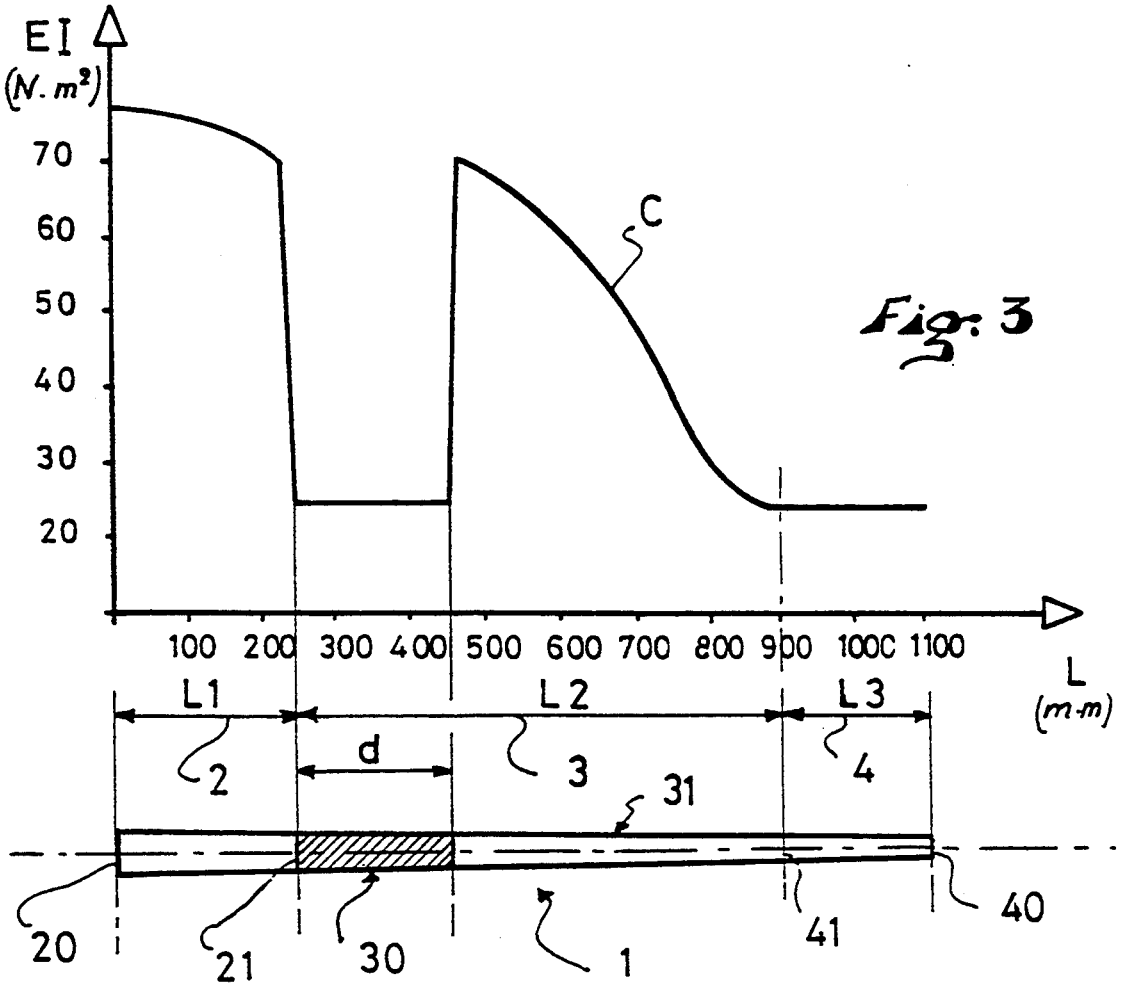
FIG. 3 represents a graph illustrating an example, as per the invention, of the distribution of flexional rigidity (EI) according to the length (L) of the shaft (curve C).

FIG. 3 illustrates an example as per the invention of the distribution of flexional rigidity in accordance with the length of the shaft. Shaft (1) can be broken down into several distinct portions. A rigid, upper portion (2) which extends from the "butt" end (20) and extends along a length (L1) at least equal to 200 mm, corresponding substantially to the length on which the hands of the player surround or embed the club. In this portion, the rigidity should be greater than or equal to $50N \cdot m^2$, preferably greater than 70 $N \cdot m^2$, so as to ensure adequate rigidity for minimal deformation that does not disturb the player.

The shaft comprises a central portion (3) which is joined to the other end (21) of upper portion (2). This portion has a length (L2) more or less substantial according to the type of shaft. This portion (3) is formed of a first zone (30) of length (d) that is especially flexible and is joined to end (21) of upper portion (2) on the one hand, and to the remaining zone (31) of central portion (3). This flexible zone has a rigidity comprised between 20 and 40 $N \cdot m^2$ and a length (d) comprised between 100 and 300 mm. However, it is important that the sum of (L1) and (d) be less or equal to 500 mm so that the shaft as per the invention may remain efficient.

Figure 4:
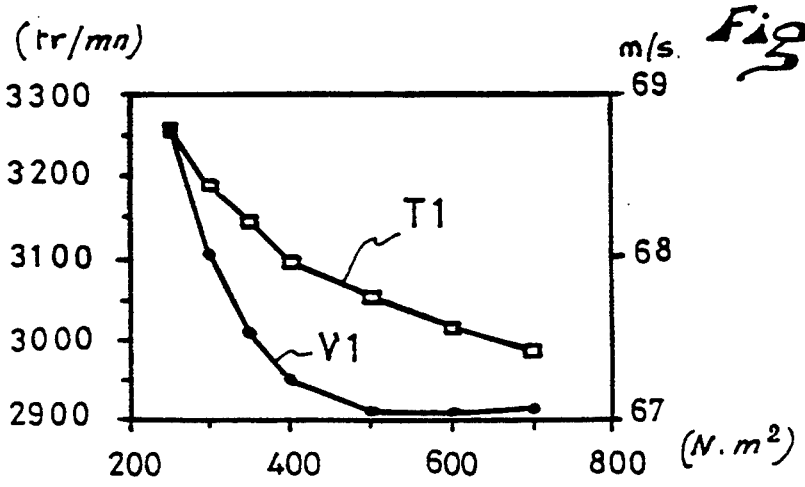
FIG. 4 represents a graph showing the influence of the position of a flexible range 100 mm long in zone (d) as per the invention (indicated in the X-axis in mm) on the evolution of the rotational speed (indicated in the Y-axis on the left and curve T1) and on the evolution of ball speed (indicated in the Y-axis on the right and curve V1).

Indeed, as is shown in FIG. 4, as an experiment, beyond approximately 500 mm, the influence of the flexible zone on the desired parameters is almost zero. Beyond this limit, speed curve (V1) gets stabilized at a lower level and rotational rate curve (T1) decreases slightly. The graph of FIG. 4 corresponds to a flexible zone having a length (d) equal to 100 mm on a normal shaft (rigidity towards the "butt" end of the shaft of $70N \cdot m^2$, rigidity towards "tip" end of 30 $N \cdot m^2$ on the last 300 mm, rigidity of $20N \cdot m^2$ of the flexible zone of variable X-axes).

The remaining zone (31), of length (L2−d) of the shaft as per the invention (FIG. 3), is joined, on the one hand, to flexible zone (30) and on the other hand, to a lower portion (4) of length (L3). The flexional rigidity of the remaining zone (31) varies in accordance with the length. Its value should be greater or equal to $50N \cdot m^2$, preferably greater than $70N \cdot m^2$ at the beginning, i.e., in the vicinity of flexible zone (30). It decreases towards lower portion (41) to attain a value at least equal to 20 $N \cdot m^2$, preferably comprised between 25 and 55 $N \cdot m^2$. The decrease is not necessarily continuous. Due to the change in the number of layers of composite material on a shaft in accordance with its length (the number of layers generally increase in the direction of the lower end), the rigidity value increases abruptly by a few $N \cdot m^2$ in the transition zone, then decreases once again due to the reduction in diameter.

However, it is necessary for the efficiency of the invention that the remaining zone (31) have an adequate rigidity level to significantly reduce the rotational rate of the ball. Finally, the shaft comprises a lower portion (4) joined by its end (41) to the remaining zone (31) of central portion (3) and ending by lower end (40). The inventor has determined that this portion of length (L3) comprised between 200 and 300 mm from the lower end (40) plays a significant role in the desired parameters during contact time with the ball. The progressive rigidification of this portion does not bring any substantial improvements to the speed of the ball, but causes a reduction in the rate of rotation from a minimal value of only $20N \cdot m^2$, which is interesting. Preferably, lower portion (4) will have a flexional rigidity that is constant or increasing slightly from end (41) connected to remaining zone (4).

Figure 5:
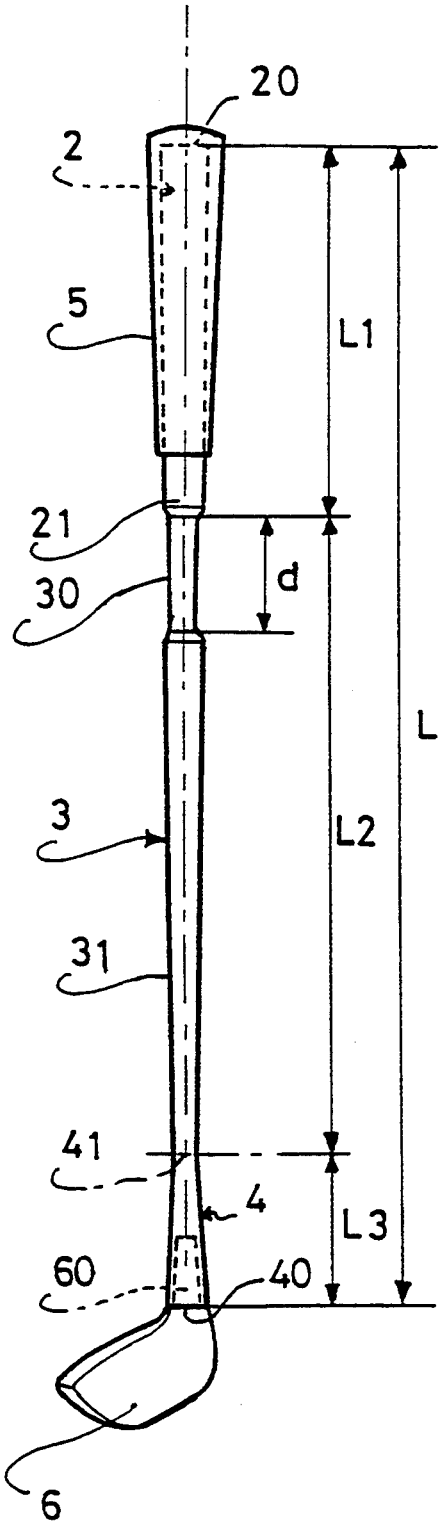
FIG. 5 shows an embodiment of a club according to the invention.

FIG. 5 illustrates a preferred embodiment of a club comprising a shaft as per the invention. The shaft comprises an upper portion (2) of length (L1) having a substantially regular truncated shape, covered at least partially, by a grip (5). The upper portion (2) is followed by a contraction extending along a length (d) and constituting the flexible zone (30) of the shaft. This contraction is obtained by an abrupt reduction in the internal diameter and the external diameter of the shaft in this zone with respect to the lower end (21) of upper portion (2). The contraction can be cylindrical or, on the contrary, slightly truncated. The remainder of the central portion is constituted of a second regular truncated portion (31) whose biggest diameter is in the vicinity of the contraction and whose smallest diameter is joined to lower portion (4) of the shaft. The latter portion has an inverted truncated shape with respect to the other truncated cones of the shaft, i.e., the smallest diameter is located at end (41), joined to central portion (3) and the biggest diameter is located at the lower end (40) of the shaft. The golf club according to the invention comprises a head (6) whose neck (60) penetrates inside lower portion (4) of the shaft, along a certain length, at least thereof.

The shaft of FIG. 5 is constructed by a stacking of composite layers of fibers, mainly of carbon and of thermoplastic or thermohardenable resin. The stacking can be obtained, in a known manner, by draping successive composite sheets, then molding. The average internal diameter at the level of flexible zone (30) containing the contraction is comprised between 6 and 7 mm. The thickness of the tubular wall in this zone is comprised between 1.5 and 2 mm approximately.

Figure 6:
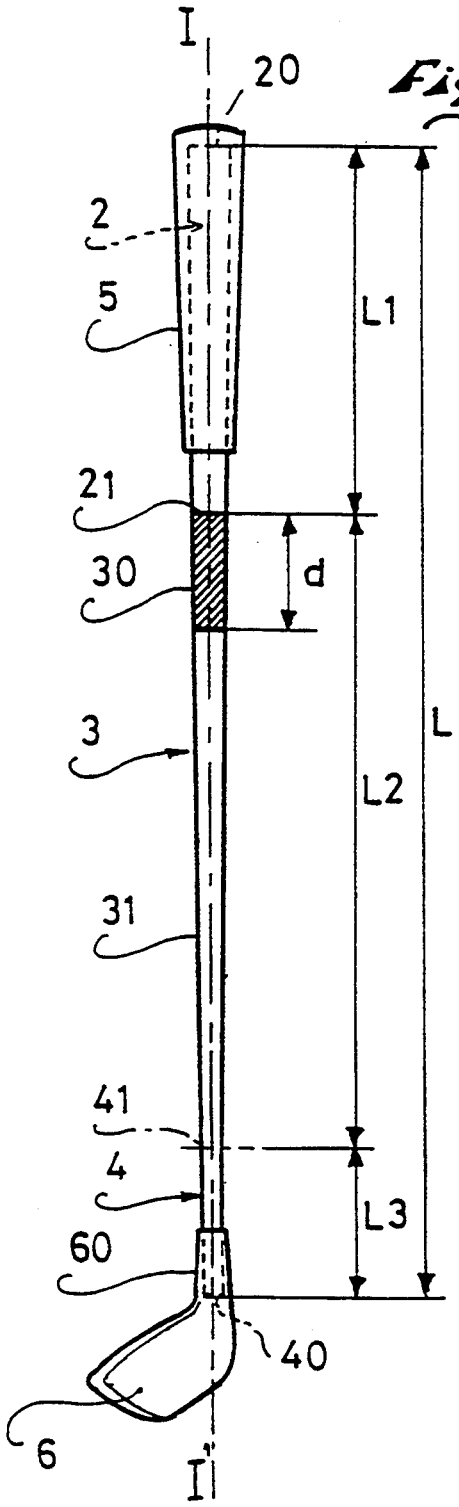
FIG. 6 shows a second embodiment of a club according to the invention.

FIG. 6 illustrates a second embodiment of the invention. The shaft has a conventional shape, i.e., it is truncated along the greater portion of its length (L). However, a small portion towards its "tip" end can be provided to be cylindrical to facilitate the adaptation of such portion with neck (60) of head (6) of the club. In fact, during assembly of the head on the shaft, it may be necessary to previously shorten the shaft to obtain the final club length desired. Naturally, the entire lower portion (4) as described hereinbefore, can also be cylindrical or even identical to the embodiment of FIG. 5. The thickness of the tubular wall of the shaft of FIG. 6 comprises a series of layers of fiber-based composite material, such fibers being oriented along a direction parallel to the longitudinal axis (I—I') of the shaft, and fiber-based layers inclined at a certain angle, preferably, ±45°, with respect to axis (I—I'). The fibers are impregnated with a thermoplastic or thermohardenable resin of the epoxy type. In flexible zone (30) of length (d), the fibers at 0° with respect to (I—I') are for the most part constituted of glass and/or aramide. Outside of this zone, the fibers at 0° are for the most part constituted of carbon. Finally, along the entire length (L) of the shaft, the inclined fibers, preferably at ±45° with respect to (I—I') can be of glass, aramide and/or carbon depending on the torsional resistance and rigidity characteristics desired.

The two examples that follow correspond to the characteristics of a shaft as per the invention respectively according to the embodiments of FIGS. 5 and 6.

EXAMPLE 1 (EMBODIMENT OF FIG. 5)

Total length (L)=1057.2 mm
Diameter at the "butt"=12.1 mm
General conicity of upper portion (2)=0.2°
Length (L1) of upper portion (2)=200 mm
Length of cylindrical contraction=100 mm
Internal diameter of contraction=8.6 mm
Composite thickness=1.75 mm
Length (L2) of central portion (3)=600 mm
Conicity of remaining zone (3)=0.2°
Length (L3) of lower portion (4)=257.2 mm
Conicity of lower portion (4)=0.3°
The type of stacking is as follows:

| Position/ butt | Number of Layers | Arrangement of Layers (from the "butt" towards "tip") |
|---|---|---|
| 0 to 300 mm | 12 layers | OA/±45B/±45B/OA/±45B/ ±45B/OA/OA |
| 300 to 1057 | 12 layers | OA/±45B/±45B/OA/±45B/ ±45B/OB/OB |

The types of materials used are:

| Number | A | B |
|---|---|---|
| Supplier | Toray ® | Toray ® |
| Material | T300 (carbon) | M40 (carbon) |
| Modulus | 112 GPa | 164 GPa |
| Thickness | 0.124 mm | 0.124 mm |
| Density | 1.52 | 1.48 |

Figure 7:
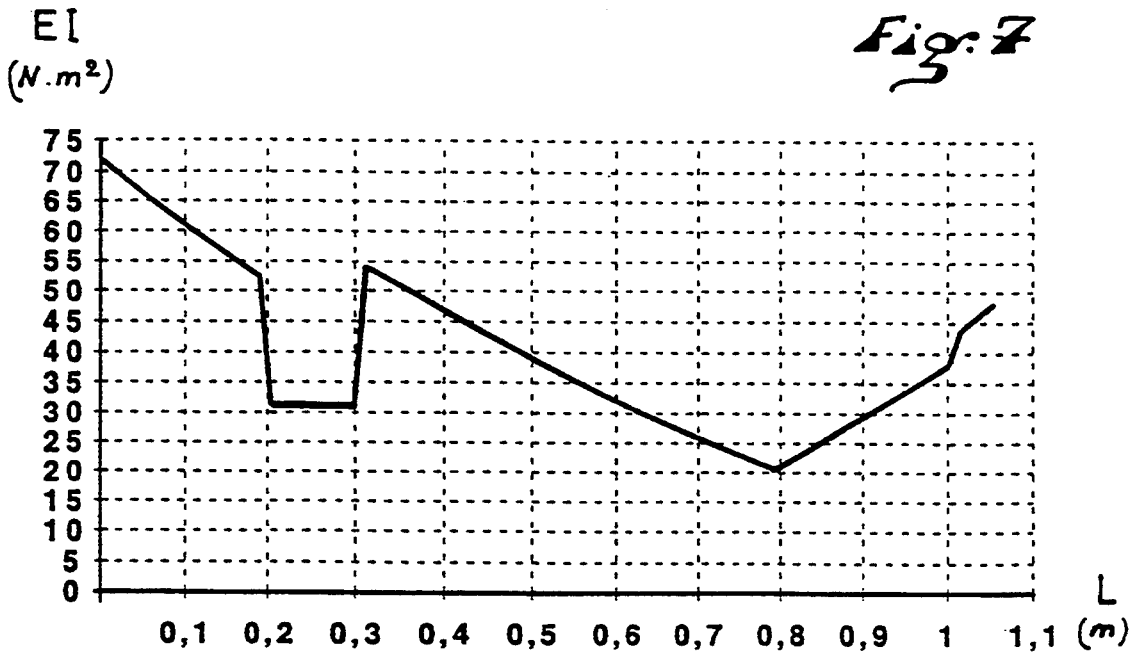
FIG. 7 represents the evolution curve of the flexional rigidity (EI), in the Y-axis, according to length (L) of the shaft, in the X-axis for example I of an embodiment as per FIG. 5.

The evolution curve of the functional rigidity according to length is provided in FIG. 7.

EXAMPLE 2 (EMBODIMENT OF FIG. 6)

Total length (L)=1057 mm
Diameter at the "butt"=12.1 mm
General conicity=0.21°
Length (L1) of upper portion (2)=200 mm
Length (d) of flexible zone (30)=100 mm
Lower portion length=250 mm
The type of stacking is as follows:

| Position/ butt | Number of Layers | Arrangement of Layers (from the "butt" towards "tip") |
|---|---|---|
| 0 to 200 mm | 12 | OA/±45A/±45A/OA/±45A/ ±45A/OA/OA |
| 200 to 300 mm | 12 | OB/±45A/±45A/OB/±45A/ ±45A/OA/OC |

-continued

| Position/ butt | Number of Layers | Arrangement of Layers (from the "butt" towards "tip") |
|---|---|---|
| 300 to 800 mm | 12 | OA/±45A/±45A/OA/±45A/ ±45A/OC/OC |
| 800 to 920 mm | 13 | OA/±45A/±45A/OA/±45A/ ±45A/OC/OC/OC |
| 920 to 1057 | 14 | OA/±45A/±45A/OA/±45A/ ±45A/OC/OC/OC/OC |

The types of materials used are:

| Number | A | B | C |
|---|---|---|---|
| Supplier | Toray ® | Toray ® | Toray ® |
| Material | T300 (carbon) | Glass | M40J (carbon) |
| Modulus | 112 GPa | 29 GPa | 190 GPa |
| Thickness | 0.124 | 0.104 | 0.124 |
| Density | 1.49 | 1.75 | 1.49 |

Figure 8:
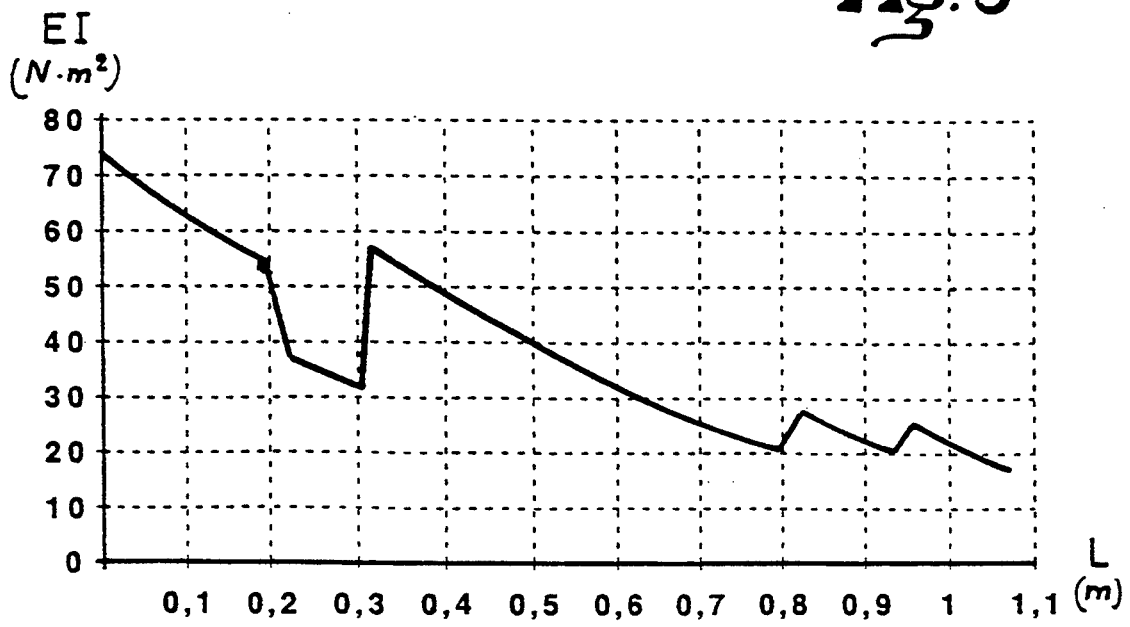
FIG. 8 represents the evolution curve of the flexional rigidity (EI), according to length (L) of the shaft for example II of an embodiment as per FIG. 6.

The evolution curve of the flexional rigidity according to length is provided in FIG. 8.

The instant application is based upon French patent application 93.07714 of Jun. 21, 1993, the disclosure of which is hereby expressly incorporated by reference thereto, and the priority of which is hereby claimed.

Naturally, the invention is not limited to the embodiments described hereinabove and comprise all technical equivalents thereof that could enter the scope of the following claims.

What is claimed:

1. A golf club shaft having a tubular section with an evolving flexional rigidity along the length of the shaft, said shaft having a plurality of portions comprising:

a rigid upper portion extending from an upper end of the shaft having the largest diameter, having a length (L1) at least equal to 100 mm, and a flexional rigidity at least equal to $50N \cdot m^2$;

a central portion joined to a lower end of the upper portion, the central portion having a length (L2);

a lower portion joined to the central portion, the lower portion having a length (L3) and extending to a lower end of the shaft, the lower end being adapted to receive a club head;

wherein the central portion comprises a flexible zone joined to the rigid upper portion, the flexible zone having a length (d) comprised between 100 and 300 mm in which the flexional rigidity is comprised between 20 and $40N \cdot m^2$, wherein $L1+d \leqq 500$ mm; and a remaining zone, joined to said flexible zone, said remaining zone having a flexional rigidity decreasing from a value greater or equal to $50\ N \cdot m^2$ in the vicinity of said flexible zone towards the lower portion to which the remaining zone is joined.

2. A golf club shaft according to claim 1, wherein the flexional rigidity of the upper portion reduces from the upper end of the shaft towards the lower end of the upper portion joined to said central portion.

3. A golf club shaft according to claim 1, wherein the lower portion has a length (L3) comprised between 200 and 300 mm and a flexional rigidity greater or equal to $20N \cdot m^2$.

4. A golf club shaft according to claim 3, wherein the flexional rigidity of the lower portion increases from an end joined to the central portion towards the lower end of the shaft.

5. A golf club shaft according to claim 3, wherein the flexional rigidity of the lower portion is substantially constant along all of length (L3).

6. A golf club shaft according to claim 1, wherein the thickness of the tubular wall of the shaft comprises a series of layers of fiber-based composite material, such fibers being oriented along a direction parallel to the longitudinal axis (I—I') of the shaft, said fibers being oriented along a direction parallel to the longitudinal axis (I—I') being for the most part fibers having an elastic modulus that is lower in the flexible zone than the elastic modulus of similarly oriented fibers outside of the flexible zone.

7. A golf club shaft according to claim 6, wherein the majority of fibers oriented in a direction parallel to the longitudinal axis (I—I') in the flexible zone are made of glass or aramide.

8. A golf club shaft according to claim 6, wherein a majority of fibers oriented along a direction parallel to the longitudinal axis (I—I') outside of the flexible zone are made of graphite.

9. A golf club shaft according to claim 6, wherein a majority of the fibers that are inclined with respect to axis (I—I') of the shaft are made of graphite.

10. A golf club shaft according to claim 1, wherein the length (L1) is 200 mm.

* * * * *